United States Patent [19]

Olson

[11] Patent Number: 4,485,600

[45] Date of Patent: Dec. 4, 1984

[54] COMPRESSIBLE SPACING AND SEALING APPARATUS FOR SIDING PANEL JOINTS

[76] Inventor: Jerome A. Olson, 14162 Pine, Omaha, Nebr. 68144

[21] Appl. No.: 348,494

[22] Filed: Feb. 12, 1982

Related U.S. Application Data

[63] Continuation-in-part of Ser. No. 322,385, Nov. 27, 1981, , and a continuation-in-part of Ser. No. 338,320, Jan. 11, 1982.

[51] Int. Cl.[3] ..... E04D 1/36

[52] U.S. Cl. ..... 52/62; 52/573

[58] Field of Search ..... 52/58–62, 52/209, 303, 302, 396, 393, 562, 573, 792, 442, 169.5

[56] References Cited

U.S. PATENT DOCUMENTS

| | | | |
|---|---|---|---|
| 849,144 | 4/1907 | Laner | 52/442 |
| 1,379,516 | 5/1921 | Benjamin | 52/62 |
| 1,389,557 | 8/1921 | Een . | |
| 1,557,481 | 10/1925 | Schneider . | |
| 1,677,130 | 7/1928 | Cherry | 52/209 |
| 1,750,526 | 3/1930 | Knox | 52/62 |
| 1,774,121 | 8/1930 | Wilson | 52/573 |
| 1,950,519 | 3/1934 | Ripley . | |
| 2,092,290 | 9/1937 | Nyhagen | 52/396 |
| 2,143,220 | 1/1939 | Cheney | 52/396 |
| 2,148,054 | 2/1939 | Berlek | 52/408 |
| 3,124,427 | 3/1964 | Chomes | 52/61 |
| 3,266,207 | 8/1966 | Birum, Jr. . | |
| 3,357,144 | 12/1967 | Chauveau et al. . | |
| 3,527,012 | 9/1970 | Hemminger . | |
| 3,604,170 | 9/1971 | Stoakes . | |
| 3,925,952 | 12/1975 | Hagel et al. . | |

FOREIGN PATENT DOCUMENTS

| | | | |
|---|---|---|---|
| 799964 | 8/1958 | United Kingdom | 52/209 |
| 1336125 | 11/1973 | United Kingdom | 52/209 |

OTHER PUBLICATIONS

Klauer, Metal Building Products.

*Primary Examiner*—Henry E. Raduazo
*Attorney, Agent, or Firm*—Henderson & Sturm

[57] ABSTRACT

A flexible flashing device for vertically stacked, building siding panels having a resiliantly deformable spacing means for accommodating the structural expansion and contraction of the underlying framework of a building. The flexible flashing device incorporates a waterproof flashing member for preventing the intrusion of water into abutting ends of vertically stacked, building siding panels. Additionally, a method of preventing contraction buckling of vertically stacked, building siding panels caused by improper installation is provided whereby the flexible flashing device is inserted between the abutting ends of two vertically stacked panels.

9 Claims, 6 Drawing Figures

COMPRESSIBLE SPACING AND SEALING APPARATUS FOR SIDING PANEL JOINTS

This application is a continuation in-part of U.S. patent application Ser. No. 322,385 filed Nov. 27, 1981 and Ser. No. 338,320 filed Jan. 11, 1982.

BACKGROUND OF THE INVENTION

The present invention relates generally to flashing structures and more particularly to a device for installing flashing between the abutting ends of vertically stacked, building siding panels.

The use of vertically stacked, 4'×8', 4'×9', or similarly sized siding panels in the exterior construction of homes and other buildings has become quite popular in recent years. Generally, these siding panels are installed over an underlying building framework consisting of vertically disposed members, "studs," and horizontally disposed members, "joists". A first row of panels is installed at ground level, securely fastened to the studs and an upper and lower joist, and vertically positioned such that its exposed, upper horizontal edge extends approximately to the midpoint of the upper joist. In order to prevent the access of the elements to this horizontal upper edge a simple metal flashing device, similar to that disclosed in U.S. Pat. No. 1,557,481, is positioned over the upper edge of the first row of panels. A second row of panels is then installed above the flashing device, followed by additional rows installed in a like manner, as necessary, until the exterior framework is entirely enclosed.

Because the underlying framework is constructed of wood and of a different composition than the siding panels, variations in moisture content, humidity and temperature will cause the framework to expand and contract in a vertical plane relative to the siding panels. This expansion and contraction is particularly acute in the horizontally disposed joists where the ends of horizontal rows of siding abutt. Internal contraction in the width of each joist forces the adjacent edges of the siding panels towards one another and if this movement of the panels due to joist contraction is not properly accommodated during installation, "popping" or pulling away of the siding panels from the framework with a resultant deterioration of the environment integrity and appearance of the exterior ensues. Correction of this problem is both difficult and expensive.

Ideally, most siding panel manufacturers direct that approximately 1/16" to ⅛" spacing be maintained between abutting panels to accommodate this relative movement. In actual construction, however, this is rarely done for a variety of reasons. First, the individuals installing the elevated rows of paneling are usually working upon a narrow scaffolding or ladder. Second, while working from this precarious position, they must lift and position an awkwardly sized panel weighing as much as 50 to 60 pounds. Finally, while holding the weight of the panel and attempting to position it so as to maintain the required spacing above the abutting lower panel, the workers must simultaneously ensure a 1/16" spacing with the horizontally adjacent panel, align the panel with both studs and joists, and drive nails through the panel to secure it to the framework. Because of the difficulty presented by this procedure, most workers simply do not leave any space whatsoever between abutting rows of stacked siding panels.

Although the prior art of flashing devices adequately provides for the environmental integrity of the panels when properly positioned, it does not aid or assist in the positioning or spacing of these panels. Consequently, there is a need for devices which will overcome the aforementioned problems by ensuring that the required spacing is maintained between panels during installation.

Furthermore, vertical siding panels, particularly those constructed of pressed hardboard fiber, have a tendency to expand or "grow" in a longitudinal direction. Therefore, in addition to the spacing which must be accommodated for relative movement of the underlying framework, additional spacing must be provided for this internal, longitudinal growth of such panels. The prior art of flashing devices does not provide a means to ensure maintenance of this additionally required spacing. Consequently, there is a need for devices which additionally ensure such a provision.

SUMMARY OF THE INVENTION

The present invention overcomes the various shortcomings and problems of the prior art by providing a flexible flashing device for vertically stacked, building siding panels. The flexible flashing device includes a resiliantly deformable spacing means for accommodating the structural contraction and expansion of the underlying framework of a building and panels. The flashing device, in addition, incorporates a waterproof flashing element for preventing the intrusion of water into the abutting ends of vertically stacked, building siding panels. Additionally, a method of preventing expansion buckling of vertically stacked, building siding panels caused by improper installation is provided whereby the flexible flashing device is inserted between the abutting ends of vertically stacked panels.

It is therefore an object of the present invention to provide an improved flashing device.

Another object of the invention is to provide a weatherproof flashing device which will ensure the provision of adequate spacing between abutting ends of vertically stacked siding panels.

An additional object of the invention is to provide a flashing device which accommodates for the internal, longitudinal expansion of vertically stacked siding panels.

A further object of the invention is to provide a method of installation of building siding panels which eliminates the potential for expansion buckling or "popping" of the panels.

Still another object of the invention is to provide a method of installation of vertical siding panels which simplifies installation to such an extent that a single person, working alone, can install the panels, while ensuring that the proper spacing between panels is provided.

Other objects, advantages and novel features of the invention will become apparent from the following detailed description of the invention when considered in conjunction with the accompanying drawings.

DESCRIPTION OF THE PREFERRED EMBODIMENT

Figure 1:
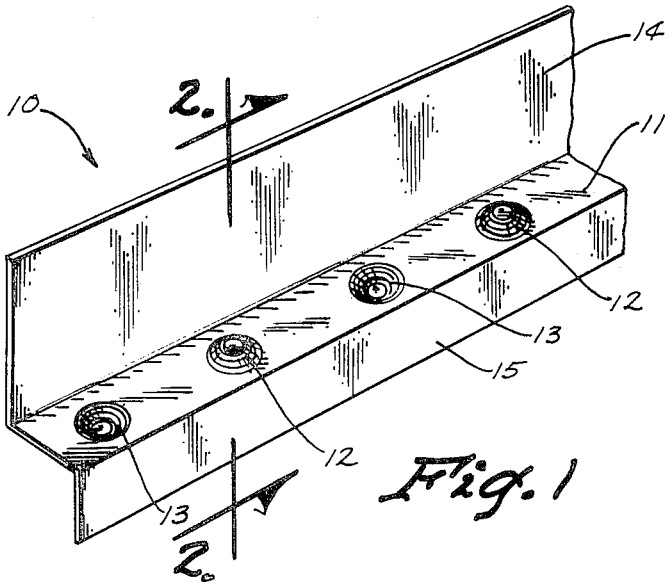
FIG. 1 is a perspective view of the preferred embodiment of the flexible flashing device of the present invention.
Figure 2:
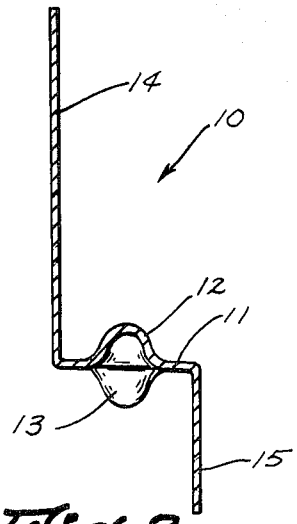
FIG. 2 is a cross-sectional view taken along line 2—2 of FIG. 1.

Referring now to the drawings, wherein like reference numerals designate identical or corresponding parts throughout the several views, FIG. 1 shows a flexible flashing device 10 constructed in accordance with the present invention.

Flexible flashing 10 includes a central portion 11 having a plurality of evenly spaced upwardly extending projections 12 formed therein, and a plurality of evenly spaced downwardly projecting projections 13 disposed therein. The flashing is preferable contrusted of sheet metal, such as aluminum, but other materials can be used instead if desired.

An upwardly extending flange 14 is connected to and extends upwardly from the central portion 11 and a downwardly extending flange 15 is connected to and extends downwardly from central portion 11.

Figure 3:
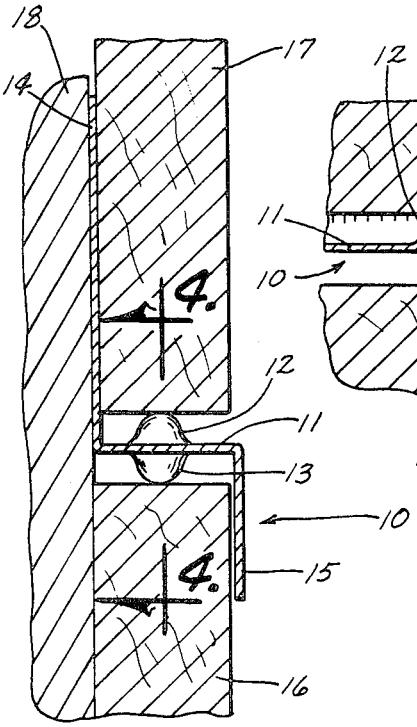
FIG. 3 is a cross-sectional view of the flashing member taken along line 2—2 of FIG. 1, but also showing the flashing in an installed position and in an uncompressed state.
Figure 4:
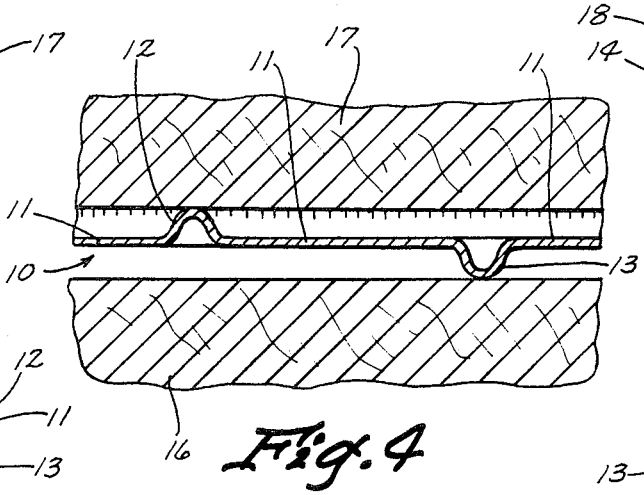
FIG. 4 is a cross-sectional view of the resiliently deformable spacing means taken along line 4—4 of FIG. 3.

Referring now to FIGS. 3 and 4, the flexible flashing device 1 is installed as follows: A first horizontal row of building side panels 16 is secured to the underlying building framework such that its upper horizontal end is positioned approximately at the mid-point of a horizontal joist 18. A flexible flashing device 10, is then placed above the first horizontal row 16 in its uncompressed state. A second horizontal row of vertically stacked siding panels 17 is then placed upon the flexible flashing device 10, as shown in FIGS. 3 and 4. The second horizontal row of siding panels 17 is then nailed or otherwise secured to the joist 32. The resiliently deformable spacing means 10 is constructed such that it is sufficiently rigid to support the weight of the upper row of siding panels until such time as the upper row is securely nailed in place. This relieves the weight of the paneling on the flexible flashing device 1. As shrinkage of the joist 18 occurs, or expansion of the panels 16 and 17, the upper row of paneling 17 and lower row of paneling 16 are forced together in a vertical direction. However, inasmuch as the flexible flashing device maintains suitable spacing between the rows of paneling, no buckling or pulling away of the siding panels occurs in the fully compressed state shown in FIGS. 5 and 6. Further pressure of the panels pushing towards each other can also be absorbed by the deformation of projections 12 and 13 and localized compression of the part of the wood siding panels immediately adjacent each respective projection 12 or 13, whereby a projection 12 or 13 will project very slightly into the respective wood siding panel.

Figure 5:
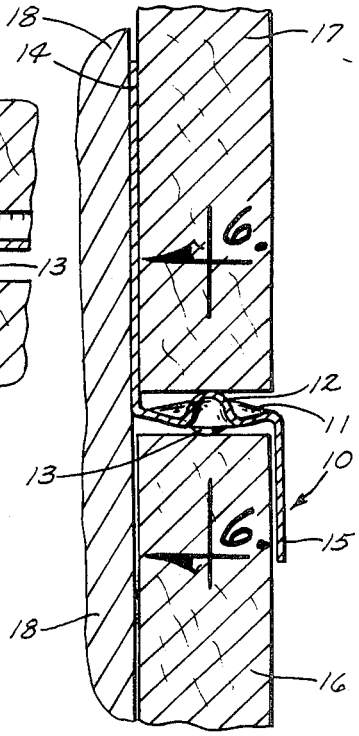
FIG. 5 is a cross-sectional view of the flexible flashing device taken along line 4—4 of FIG. 3 and showing the device as installed in a compressed state.
Figure 6:
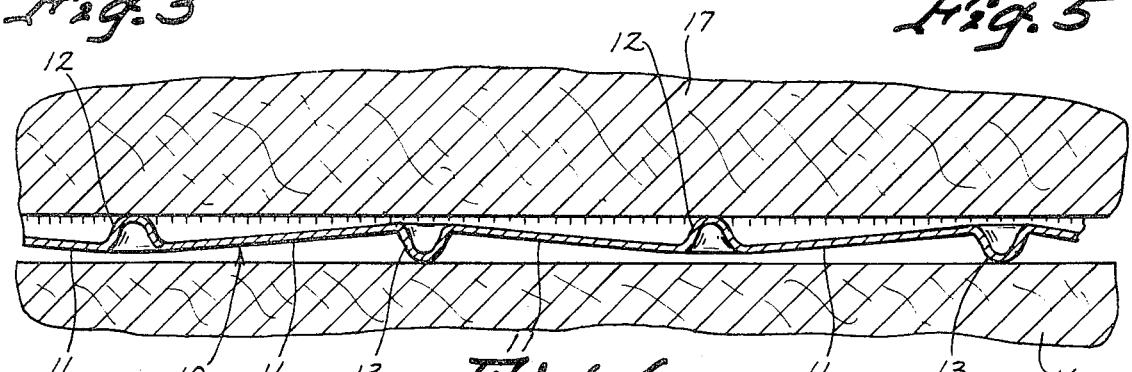
FIG. 6 is a cross-sectional view of the device as taken along line 6—6 of FIG. 5, after installation and after it has assumed a compressed state.

Moreover, in either the compressed state shown in FIGS. 5 and 6, or the uncompressed state shown in FIGS. 3 and 4, the flashing member 10 protects the upper edge of the panel 16 from moisture intrusion.

Consequently, by eliminating the difficult and time-consuming process of precise spacing and measurement, the present invention enables one individual to install, place and secure a row of panels with a minimum of labor, while ensuring that proper spacing is maintained. The resulting siding structure consequently retains its structural integrity and appearance regardless of any expansion or contraction or adverse environmental conditions.

Obviously many modification and variations of the present invention are possible in light of the above teachings. It is therefore to be understood that, within the scope of the appended claims, the invention may be practiced otherwise than as specifically described.

I claim:

1. A flashing apparatus for spacing and sealing adjacent panels comprising:

a central portion lying substantially in one plane and having a front edge and a rear edge;

first upwardly extending flange connected to and extending from the rear edge of said central portion;

a secondly downwardly extending flange connected to and extending from the front edge of said central portion; and an improvement comprising:

a plurality of projection means extending from said plane for resiliently spacing said siding panels apart, adjacent ones of said projection means alternatively extending upwardly and downwardly near the longitudinal center of the central portion and substantially evenly spaced apart along a substantial length of said central portion, each of said projection means being rigidly connected to said central portion about the entire periphery thereof along said plane whereby said central portion between adjacent projection means can flex to allow for expansion or contraction of the panels disposed on opposing sides thereof;

a first wooden panel disposed underneath said central portion and having a top planar surface therein in abutment with said downwardly extending projection means and having said second downwardly extending flange extending parallel to a front top edge thereof;

a second wooden panel disposed above said central portion and having a bottom planar surface in abutment with said upwardly extending projection means and also having a lower rear portion thereof in abutment with said first upwardly extending flange; and a wooden stud in abutment with said first upwardly extending flange and with the top rear portion of said first wooden panel whereby expansion of said first and second panels due to varying moisture content and temperature changes is permitted without causing buckling of said first and second wooden panels.

2. The flashing apparatus of claim 1 wherein said flashing apparatus is of integral, one piece construction.

3. The flashing apparatus of claim 2 wherein said flashing apparatus is constructed of aluminum.

4. The flashing apparatus of claim 1 wherein said first flange is substantially planar for permitting it to fit tightly between one of said panels and studs on a building frame.

5. The flashing apparatus of claim 4 wherein said second flange is substantially planar in shape.

6. The flashing of apparatus of claim 5 wherein said planes of said first and second flanges are parallel with respect to each other.

7. The flashing apparatus of claim 6 wherein the plane of said central portion is substantially perpendicular to the planes of said first and second flanges.

8. The flashing of claim 7 wherein said projection means are smaller in length and width than the width of said central portion.

9. The flashing apparatus of claim 1 wherein all of said projection means are formed upwardly or downwardly from a straight line extending through said central portion.

* * * * *